United States Patent [19]

Higuchi et al.

[11] Patent Number: 4,790,913

[45] Date of Patent: Dec. 13, 1988

[54] METHOD FOR PRODUCING AN SN-BASED MULTILAYER COATED STEEL STRIP HAVING IMPROVED CORROSION RESISTANCE, WELDABILITY AND LACQUERABILITY

[75] Inventors: Seizun Higuchi; Tomonari Oga; Masao Ikeda; Hirohumi Nakano, all of Kitakyushu, Japan

[73] Assignee: Nippon Steel Corporation, Tokyo, Japan

[21] Appl. No.: 71,974

[22] Filed: Jul. 10, 1987

Related U.S. Application Data

[62] Division of Ser. No. 879,273, Jun. 27, 1986, Pat. No. 4,713,301.

[30] Foreign Application Priority Data

Jul. 1, 1985 [JP] Japan ..... 60-144174

[51] Int. Cl.[4] ..... B32B 15/01

[52] U.S. Cl. ..... 204/37.3; 204/41

[58] Field of Search ..... 204/41, 37.3; 428/628, 428/632, 646, 648

[56] References Cited

U.S. PATENT DOCUMENTS

| | | | |
|---|---|---|---|
| 3,295,936 | 1/1967 | Asano et al. | 204/37.3 |
| 4,561,943 | 12/1985 | Mochizuki | 204/37.3 |
| 4,601,957 | 7/1983 | Fujimoto | 204/37.3 |

*Primary Examiner*—Sam Silverberg

*Attorney, Agent, or Firm*—Kenyon & Kenyon

[57] ABSTRACT

The Sn based multilayer coated steel strip for container-use is improved by the provision of a novel underyling coating of ternary Fe-Ni-P alloy which, mainly because of the Ni component, ensures a uniform deposition of the Sn layer, and mainly because of the P and Fe contents ensure a satisfactory remaining amount of free Sn for improving the weldability. The steel strip has a thin Sn plated layer and a chromate coating layer on the underlying coating.

12 Claims, 3 Drawing Sheets

METHOD FOR PRODUCING AN SN-BASED MULTILAYER COATED STEEL STRIP HAVING IMPROVED CORROSION RESISTANCE, WELDABILITY AND LACQUERABILITY

This is a division of application Ser. No. 879,273, filed June 27, 1986, now U.S. Pat. No. 4,713,301.

BACKGROUND OF THE INVENTION

1. Field of the Invention

The present invention relates to an Sn-based multilayer coated steel strip having improved electric-resistance weldability and improved corrosion-resistance for use in general-purpose food cans and beverage cans. The present invention also relates to a method for producing the Sn-based multilayer coated steel strip.

2. Description of the Related Arts

Recently, various manufacturing methods and design of the beverage cans and food cans have been increasingly developed. These container materials recently for such cans should be inexpensive and exhibit superior characteristics.

The electric resistance welding process, e.g., Soudronic welding process, is widely employed in can manufacturing, because of advantages such as a high material yield, and a bonding strength high enough that leakages due to a bonding failure are kept to an extremely low level, and that cans of various designs can be produced. Cans to be produced by the above welding process were heretofore made from Sn-plated steel sheet having an Sn plated amount of #10 (amount of plated Sn=1.12 g/m$^2$) or more preferably #25 (amount of plated Sn=2.8 g/m$^2$) or more. Nevertheless, a serious disadvantage of the Sn-plated steel sheet is that, due to increased tin prices, such a steel sheet has become expensive. Various attempts have been made to decrease the amount of plated Sn and thus attain a cost reduction, but the decrease in the amount of plated Sn cause a problem of degradation of the corrosion resistance and weldability. Recently, multilayer coated materials for container use have been developed, as disclosed in Japanese Unexamined patent publication Nos. 57-23,091, 57-200,592 and 57-110,685, as alternative materials to the Sn plated steel sheet. The production methods of these mutlilayer coated materials utilize various combinations of surface treatments of the steel sheet, i.e., Ni-plating, Sn-plating with a thin deposition amount, alloying-diffusion treatment of Ni-Sn (heating- and melting-treatment), and chromate treatment. The steel sheets so produced have a dual coating. In these steel sheets, due to the superimposing effects of the dual coating, the number of pinholes is reduced, and due to a dense formation of an Ni-Sn alloy layer, the ATC (alloy tin couple) value is lessened, and hence the corrosion resistance is enhanced. In these steel sheets, particularly when the underlying Ni plating layer is formed, the formation of an alloying layer of Fe and Sn ($FeSn_2$ alloying layer), which occurs during the high temperature-heating step of the can manufacture involving welding or at the high temperature-sterlization step subsequent to filling of the can, is suppressed and the weldability and the appearance of the welded parts are improved.

When the known steel sheets for container use are considered in detail, it cannot be necessarily concluded that the requisite properties are ensured. Referring to FIG. 1, the dissolution speeds of Sn of the various Sn plated layers in the model corrosive liquid are shown.

The model corrosive liquid was a solution containing 1.5% of citric acid and 1.5% of sodium chloride. The dissolution test was carried out under the measurement condition of a temperature of 27° C. and an $N_2$ atmosphere.

The test samples had the following coating structures.

● . . . Undercoating: (Fe-18% Ni-1.7% P) alloy plating (160 mg/m$^2$)→Sn plating (780 mg/m$^2$)→heating and melting treatment→chromate treatment (10 mg/m$^2$).

○ . . . Undercoating: (Fe-20% Ni) alloy plating (200 mg/m$^2$)→Sn plating (800 mg/m$^2$)→heating and melting treatment→chromate treatment (9 mg/m$^2$)

Δ . . . Undercoating: Ni plating (25 mg/m$^2$)→Sn plating (800 mg/m$^2$)→chromate treatment (8 mg/m$^2$)

□ . . . Undercoating: (Fe-10% Ni) diffusion coating layer (Ni plating at 50 mg/m$^2$ followed by diffusion treatment)→heating and melting treatment→chromate treatment (8 mg/m$^2$)

x . . . Sn plating (850 mg/m$^2$)→heating and melting treatment→chromate treatment (9 mg/m$^2$)

▲ . . . Undercoating: (Ni-16% P) alloy plating (60 mg/m$^2$)→Sn plating (850 mg/m$^2$)→chromate treatment As is understood from the ○, Δ, and □ curves, when the dual layer plated steel sheets comprising the Ni undercoating plating and the Sn plating are exposed to corrosive environments, the dissolution speed of Sn lessens at the initial corrosion stage, and hence, the initial corrosion resistance of these steel sheets is excellent. Nevertheless, when they are exposed to a corrosive environment over a long period of time, the Sn is consumed and the alloy layer may be exposed. Under such circumstances, no matter how dense the alloy layer, it is not free of pinholes, so that a local cell is formed and the corrosion is promoted. In the local cell, the Ni-Sn alloy layer is electric potentially extremely noble or cathodic relative to the steel base, with the result that the parts of the steel base exposed by the pinholes are preferentially dissolved. As a result, the corrosion resistance is degraded and, occasionally, piercing corrosion occurs. The piercing corrosion may occur because the exposed alloy layer or base steel is exposed due to flaws formed during the can manufacture. In this case, the base steel dissolves and the corrosion resistance is degraded.

Regarding the welding procedure, the speed of this procedure has been greatly increased, recent and accordingly, a higher weldability has become necessary. The amount of non-alloyed Sn (free Sn) is decisive when considering the weldability, and therefore, it is essential to suppress the reactions for the alloy formation occurring during the lacquer paint coating, thereby increasing the residual amount of free Sn. The underlying Ni plating of the current steel sheets used for containers, is effective to a certain degree in suppressing the alloy formation, but because of the high diffusion speed of Ni and Sn, it is diffucult to ensure a sufficient amount of free Sn is available for improving the weldability. Particularly, when the deposition amount of Sn is small, the excellent weldability needed to attain a high welding speed is not necessarily obtained by the underlying Ni plating.

Note, cans having easy-to-open ends (EOE) do not require cutting and can be easily opened anywhere. The EOE cans are used for all beverage cans and will probably be used for all food cans in the future. Al sheets provide a good end openable property and are widely used for the EOE materials. Surface treated steel sheets (tin plate) are used for foods cans to hold foods containing sodium chloride, for example, tomato juice, for which the Al cannot be used because of an insufficient corrosion resistance thereto. Recently, however, the materials of steel sheets and the designs for can ends have been improved, and tin plates having as good an openable property as the Al sheet have been produced for the ends of EOE cans. New materials, which will make it possible to reduce costs, are now required.

Not only a good weldability but also good lacquerability and, corrosion resistance after baking are needed for the materials used for welded cans. The materials used for the ends of EOE cans are subjected to score forming, i.e., the formation on the surface of an end, of a V-notch which facilitates can opening and allows the formation of a satisfactory opening for removing the content of the can therethrough. These materials are further subjected to bulging and the drawing of a tab, which acts as the starting point of tearing and staking, i.e., rivetting, for fixing the tab. Since the bulging, drawing, and rivetting are severe working, the steel sheet must have a good formability. In addition, the following properties are required for the surface coating layers.

A. No cracks formed on the surface coating layer due to rivetting or scoring, and even if cracks are formed, they do not reach the base steel.

B. The lacquerability of the worked parts is not degraded.

Regarding ends other than the ends of EOE cans, and the can drums, the materials are subjected to severe working, such as winding-fastening by winding or bending, and thus the materials used must satisfy the same properties as described above.

SUMMARY OF THE INVENTION

Figure 1:
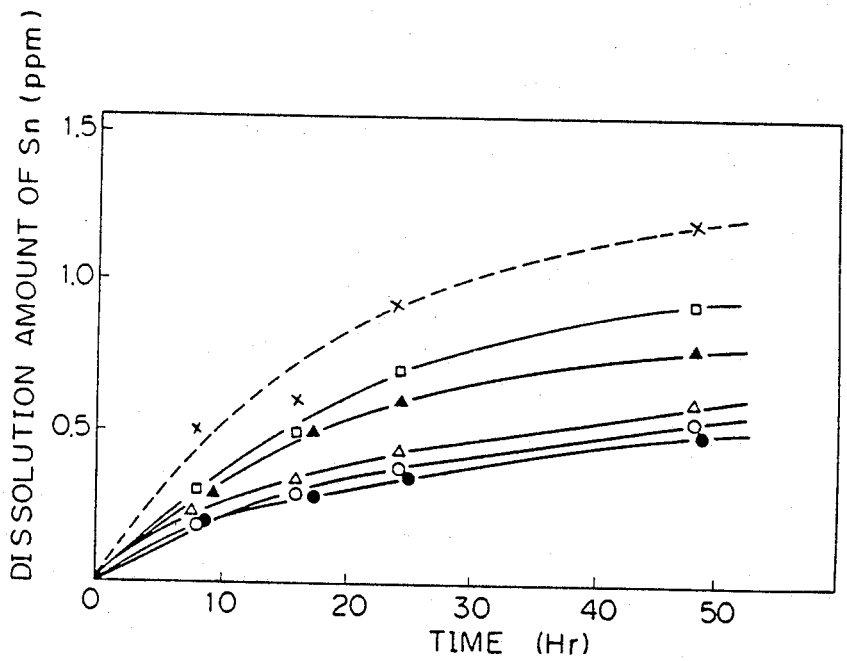
FIG. 1 is a graph illustrating the dissolution speed of the various Sn-based alloy plated layers.

It is an object of the present invention to provide a material for use as a welded can, which is inexpensive and can replace the conventional tin plates having a high Sn deposition amount and which exhibits an improved weldability, corrosion resistance, and lacquer adherence property.

Therefore, in accordance with the present invention, there is provided an Sn-based multilayer coated steel strip, characterized by having an Fe-Ni-P based, underlying coating layer, an Sn plated layer on the underlying coating layer, and a chromate coating layer on the Sn plated layer.

DESCRIPTION OF THE PREFERRED EMBODIMENTS

The steel strip having the coating layers according to the present invention is used for welded cans which are subjected to lacquering and then an electric welding resistance process during manufacture, or for ends of EOE cans which are subjected to severe working during manufacture.

The Fe-Ni-P based, underlying coating layer is described in comparison with the Ni or Ni-P underlying coating layer.

(a) Ni underlying coating layer

When an Ni-based steel sheet is subjected to the Ni-based undercoating treatment, such as formation of an Ni or Ni-Fe alloy, the electrolytic deposition of the Sn layer on the underlying layer is improved, and in addition, a uniform and dense layer alloy of Ni and Sn is formed. As a result, the pinholes are lessened even when only a small plating amount of Sn is used. Accordingly, a reduction in the dissolution speed of Sn, which will improve the corrosion resistance, can be expected. Also, when a steel sheet is subjected to lacquer baking, and thus heated at a temperature of from 160° to 220° C. for approximately 20 to 60 minutes, a considerable amount of the free Sn is expected to remain.

But, since the speed of diffusion between metallic Ni and Sn is high, the amount of free Sn remaining is not necessarily satisfactory.

(b) Fe-P or Ni-P underlying coating layer

The undercoating treatment by Fe-P or Ni-P is extremely effective for causing the free Sn to remain after the lacquer baking treatment, but is not satisfactory for providing a uniform coating of the Sn plated layer. Also, the Sn plated layer has numerous pinholes.

(c) Fe-Ni-P underlying coating layer

The Sn based multilayer coated steel strip for welded-container-use is improved by the provision of a novel underlying coating of ternary Fe-Ni-P alloy which, mainly because of the Ni component, ensures a uniform deposition of the Sn layer, and mainly because of the P and Fe contents ensure a satisfactory remaining amount of free Sn for improving the weldability. This layer attains the same uniform electrolytic deposition of Sn as the Ni underlying coating layer (a), and in addition, suppresses the reaction between the P-based underlying coating layer (b) and the Sn plated layer, as does the P-based underlying coating layer (b). The Fe-Ni-P based underlying coating layer is effective for providing a uniform electrolytic deposition of the Sn plated layer and for reducing the number of pinholes by the formation of a dense alloy layer, even when the amount of Sn deposited is extremely small.

Figure 2:
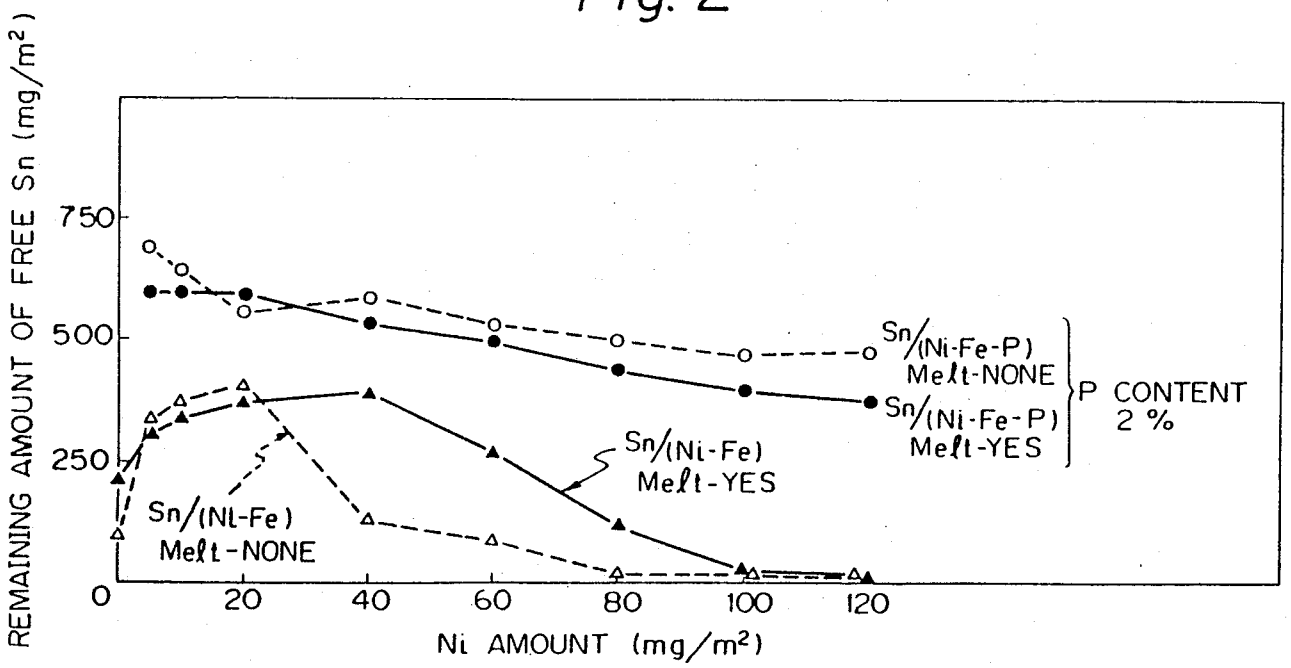
FIG. 2 is a graph illustrating the free Sn-residue amount of Sn plated steel sheets subjected to an undercoat treatment by Ni-Fe-P alloy or Ni-Fe alloy; and, FIG. 3 is a graph illustrating the relationships between the coulobm of electricity of the chromate treatment and the chromium deposition amount.

The effects of the Fe-Ni-P based underlying coating layer for suppressing the diffusion reaction between the same and the Sn-plated layer during the lacquer baking, and hence for causing the free Sn to remain, are apparent from FIG. 2.

The amount of free Sn remaining was measured under the following conditions.

Test pieces (Sn coating amount-#8) were baked three times at 205° C. for 10 minutes and then the Sn coating was electrically dissolved in a 5% NaOH solution. The Sn amount was measured, before and after the dissolution, by fluorescent X ray analyzer. The difference in the Sn amount was taken as the amount of free Sn remaining. When the remaining amount of free Sn is high, and providing that there is an identical deposition amount of Sn, a steel sheet having such a large amount of free Sn remaining is advantageous, when compared with a steel sheet having only a small amount of Sn remaining, with regard to flaw generation in a coating layer and corrosion protection of defects in a coating layer. In addition, when such cans are exposed to a corrosive environment, the period in which the Sn plated layer is lost is prolonged, that is, the non-corrosion period is advantageously prolonged, when there is a large amount of free Sn remaining.

The Fe-Ni-P underlying coating layer is also effective for preventing cracks occurring when the steel sheet is subjected to severe working, such as rivetting and scoring working.

The preferred embodiments of the present invention are described hereinafter.

The steel sheet to which the Sn-based multilayer coating according to the present invention is applied, may be a steel sheet which is generally and widely produced at present by the steel industry for use as a tin plate, a tin free steel (T.F.S), and the like. Such a steel sheet is produced by the steps of cold-rolling, annealing, and temper rolling, or occasionally second cold-rolling. The steel sheet so produced is referred to as a black plate. Various kinds of steel sheets processed as black plate can be used in the present invention. The steel sheet so processed is subjected to a pretreatment for surface activation, by alkali washing and then pickling. The Fe-Ni-P alloy is then plated on the surface-activated steel sheet. The plating bath for the Fe-Ni-P alloy may be one of a number of baths, such as sulfate bath, chloride bath, chloride-sulfate bath, cyanate bath, cirtric acid bath, and pyrophosphoric acid bath, but is preferably a sulfate bath, sulfate-chloride bath, or chloride bath in the light of bath operation and cost. An example of the sulfate bath contains ferrous sulfate, nickel sulfate, phosphorus acid, phosphoric acid, sodium acetate, and sodium sulfate.

The Fe-Ni-P underlying coating layer preferably has a coating amount in the range of from 10 to 300 mg/m$^2$ per one side of the sheet. When the coating amount is less than 10 mg/m$^2$, the steel sheet (black plate) for plating is not satisfactorily uniformly covered by the Fe-Ni-P alloy layer, with the result that it becomes diffucult to attain a uniform covering by the Sn plated layer and the desired suppression of alloy formation between the Ni and Sn so as to provide a large amount of remaining free Sn. If the coating amount is less than 10 mg/m$^2$, the improvements in the corrosion resistance and weldability are attained only with difficulty. On the other hand, when the coating amount exceeds 300 mg/m$^2$, not only is there a saturation of the effects of the Fe-Ni-P based underlying coating layer but also the resultant hard characteristic becomes a source of cracks generation when the steel sheet is deformed, thereby degrading the corrosion resistance. The coating amount of Fe-Ni-P underlying coating layer is preferably in the range of from 30 to 250 mg/m$^2$.

The Fe-Ni-P underlying coating layer has the following composition. The Ni content in the Fe-Ni-P underlying coating is preferably from 5 to 30%. When the Ni content is less then 5%, the effect of Ni for realizing a uniform Sn plated layer practically nonexistent. On the other hand, when the Ni content exceeds 30%, the effect of Ni for realizing a uniform Sn plated layer tends to become saturated and the diffusion reaction between Ni and Sn is exceedingly enhanced during the lacquer baking to reduce the amount of remaining free Sn. In this case, the weldability and corrosion resistance are degraded. A preferable Ni content is from 10 to 25%.

When the P content is less than 0.1%, the effect of P for suppressing the diffusion reaction between the Sn and the Fe-Ni-P based underlying coating layer is small, and hence the amount of remaining free Sn also is small. In this case, the weldability and corrosion resistance are degraded. On the other hand, when the P content exceeds 10%, a uniform electrolytic deposition of the Sn plated layer is impeded and the formation of pinholes is increased, with the result that the corrosion resistance is greatly degraded. A preferred P content is from 1 to 5%.

The Fe-Ni-P based underlying coating layer may contain, as unavoidable impurities, Co, Sn, and the like, which do not impede the effects of Fe, Ni, and P.

When the Fe-Ni-P based underlying coating layer is formed, then the layer is rinsed with water and is subjected, directly or after activation by pickling, to the overlying coating by Sn. The Sn plating method is not limited with regard to the procedure thereof and the electrolytic treating conditions. Any of the ferrostan baths or halogen baths which are used at present for the production of tin plates, or any other electroplating bath, may be used. Since the Fe-Ni-P based underlying coating layer will realize, even at a small plating amount of Sn, the formation of a uniform and dense Ni-Fe-Sn-P alloy layer, an ensured free Sn coating layer, and a uniform electrolytic deposition of Sn coating, the deposition amount of Sn can be small, preferably not more than 2500 mg/m$^2$, more preferably not more than 1500 mg/m$^2$. If the deposition amount of Sn is exceedingly small, only a small amount of the free Sn remains when a steel sheet is subjected to heating during the process of manufacturing cans. In this case, the corrosion protection of defective plating parts by the Sn plated layer is not satisfactory. In addition, the Sn plated layer is converted to a virtually alloyed layer containing Ni, Fe, Sn, and P, thereby lessening the amount of remaining free Sn. Further, in this case, the contact resistance of the Sn plated layer is high, thereby degrading the weldability. A preferred deposition amount of Sn is not less than 50 mg/m$^2$, more preferably not less than 100 mg/m$^2$.

The steel sheet having the Sn plated layer may be subjected to a heating and melting step (sometimes referred to as the melt treatment) as carried out in a conventional production step for producing a tin plate. This heating and melting treatment is particularly advantageous in the present invention, because the Sn under the melting state reacts, in a short period of time, with the Fe-Ni-P based alloy coating layer, and an extremely uniform and fine Ni-Fe-Sn-P alloy layer is formed, thereby extremely reducing the ATC value and greatly suppressing, by this Ni-Fe-Sn-P layer, the decrease in free Sn. This is particularly advantageous for the weldability and corrosion resistance. The decrease in the ATC value leads to a decrease in the dissolution speed of Sn in an environment corrosive to Sn as shown in the dot/dash curve of FIG. 1. This is advantageous in the light of under-lacquer corrosion when coated with paint.

The uniform and dense Ni-Fe-Sn-P based alloy layer formed by the melt treatment contains, by weight percentage, from 2 to 20% of Ni, from 0.05 to 5% of P, and from 20 to 50% of Fe, the balance being Sn. Within this composition range, the Ni-Fe-Sn-P based alloy layer exhibits the excellent properties described above. The present invention is not limited to formation of the uniform and dense Ni-Fe-Sn-P based alloy layer by means of Sn plating and then melt-treating, but also may be embodied in such a manner that this Ni-Fe-Sn-P based alloy layer is formed by electroplating and an Sn plated layer is formed on this alloy layer.

The heating and melting treatment is carried out as follows. An Sn-plated steel sheet is rinsed with water and is subjected, directly or after application of an aqueous solution-flux, to heating at a temperature of from 240° to 350° C., preferably from 250° to 300° C., to melt the Sn plated layer. The heating is carried out in air or a non-oxidizing atmosphere, e.g., $N_2$ atmosphere. The aqueous solution-flux is usually an Sn plating bath in which the Sn concentration is reduced compared with that for electroplating. A steel sheet is immersed in this plating bath so that the aqueous solution in the bath is applied on the Sn-plated surface of the steel sheet, which is then heated to melt the plated Sn. This method of applying the flux, however, gives the steel sheet a blackish luster appearance, because the appearance of the steel sheet is influenced by the underlying Fe-Ni-P alloy coating layer. A white luster appearance is advantageously obtained when an Sn-plated steel sheet is immersed in city water or a dilute solution having a concentration one tenth or less that of the plating bath, and is then subjected to the melting treatment. Ni and P partly intrude into the steel when the heating and melting treatment or paint baking is carried out at a high temperature. The diffusion layer so formed does not impede the effects to be attained by the present invention.

The Sn plated layer formed in the present invention may be a uniform layer or nonuniform Sn layer in the discontinuous distribution, which are inevitably formed due to the melt treatment.

According to the present invention, the surface of the Sn-plated layer is subjected to a chromate treatment, so as to improve the paintability and the coating properties. The chromate treatment is outstandingly effective for improving the adhesion of paint for cans and for preventing the so called undercutting corrosion, according to which the content in the form of an aqueous solution permeates through the coating and promotes the corrosion at the interface between the plating surface and the lacquer. When the undercutting corrosion is prevented, the adhesion of the lacquer does not deteriorate and a good corrosion resistance is maintained for a long period of time. The chromate coating is extremely effective for preventing sulfide-staining, that is, the appearance of the steel sheet becomes blackish when the content is a sulfur-containing food, such as fish or live-stock products. The chromate coating is advantageous for lacquered cans but is disadvantageous for welding. The chromate coating herein indicates the single coating of hydrated chromium oxide, i.e., the chromate coating in the original meaning, and the dual coating consisting of underlying metallic Cr and overlying hydrated chromium oxide. The hydrated chromium oxide is electrically insulative, and hence exhibits a high electric resistance. The metallic chromium has a high electric resistance and a high melting point. Both hydrated chromium oxide and metallic chromium therefore degrade the weldability. A preferred amount of the deposition amount of the Cr-bearing material in terms of metallic Cr is in the range of from 5 to 50 mg/m$^2$, in the light of corrosion resistance and weldability. A more preferred deposition amount of the Cr-bearing material is from 7.5 to 35 mg/m$^2$. When the deposition amount of the chromium-bearing material is less than 5 mg/m$^2$, the chromate coating is not very effective for improving the lacquer adhesion or for preventing the undercutting corrosion. On the other hand, when the deposition amount of the chromium-bearing material exceeds 50 mg/m$^2$, the appearance degrades and the contact resistance becomes so high that it becomes necessary to enhance the welding current. In this case, expulsion and surface flash are liable to be generated and the welding conditions become restricted, which indicates that the weldability is degraded.

The chromate treatment is carried out as follows.

The aqueous solution containing a chromic acid, and Na, K or ammonium salt of various chromic acids is used for either the immersion treatment, spraying treatment, or electric cathodic treatment. The electric cathodic treatment is preferred, particularly when the aqueous solution used for this treatment contains $CrO_3$, $SO_4$ ions, and F ions including complex ions, or a mixture thereof. The concentration of $CrO_3$ is in the range of from 20 to 100 g/l but is not specifically limited. When the total of anions added is from 1/300 to 1/25 times, preferably from 1/200 to 1/50 times, the ion concentration of hexa valent-Cr, the optimum chromate coating is obtained. When the ion concentration of anions is less than 1/300 times the Cr ions, it is difficult to obtain a chromate film which is dense and uniform and exerts a favourable influence upon the painting characteristics. On the other hand, when the ion concentration of anions exceeds 1/25 times the Cr ions, the amount of anions trapped in the chromate layer being formed is so increased that the chromate coating properties are degraded. The temperature of the chromate treatment-bath is not specifically limited but is advantageously from 30° to 70° C. in the light of suitable operation. The current density of the electric cathodic treatment is sufficient when in the range of from 5 to 100 A/dm$^2$. The treatment time is adjusted in combination with the above described treating conditions so as to attain a predetermined deposition amount of chromium bearing material.

Figure 3:
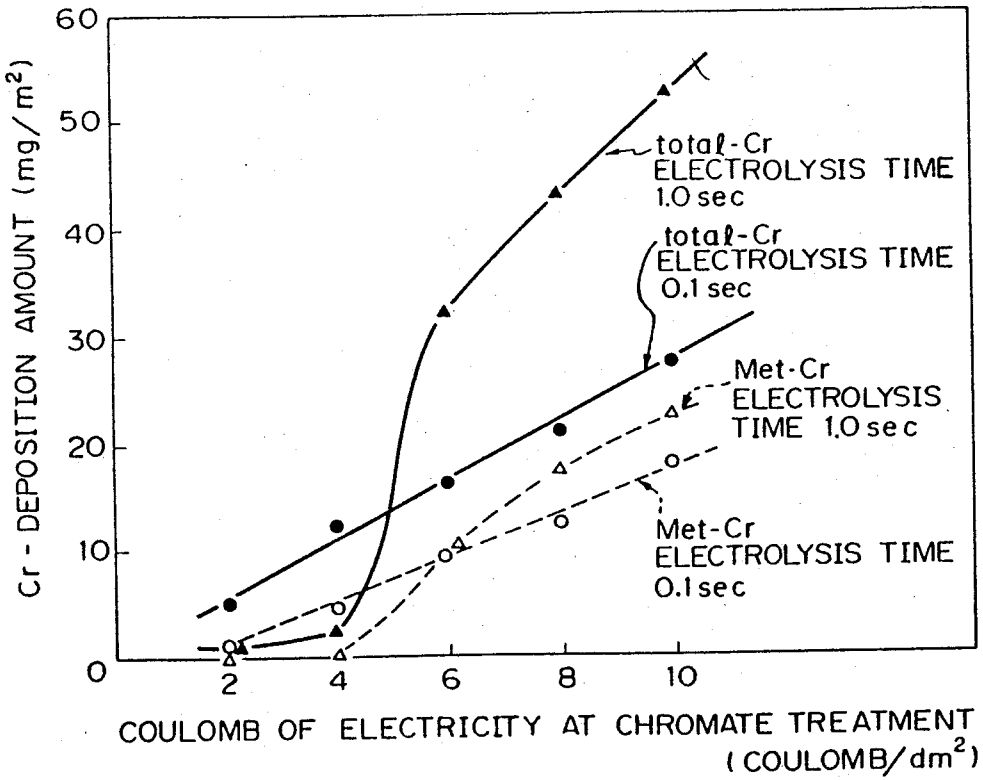

A preferred treating condition of the chromate treatment includes the following provisos: the solution contains $CrO_3$; the concentrations of $SO_4^{-2}$ and $F^-$ are within the ranges as described above; the current density is in the range of from 50 to 100 A/dm$^2$; and, the treatment is for a short period of time such as 0.2 second or less. As shown in FIG. 3, the metallic Cr layer is deposited on the Sn-plated layer at an amount of from 5 to 15 mg/m$^2$, and the hydrated chromium oxide layer is formed on this Cr layer. Thus, a dual chromium layer is formed. The amount of hydrated chromium oxide layer is regulated by adjusting the immersion time of in the solution, in which a workpiece is subjected to chromate treatment and is then immersed for adjusting the amount of hydrated chromium oxide. Alternatively, the workpiece is immersed in a separate tank containing a $CrO_3^-$-anionic bath having a $CrO_3^-$ concentration different from that of the bath for chromate treatment. In FIG. 3, the relationship between the electrolytic conditions for the chromate treatment and the deposition amount of chromium is shown.

When the metallic chromium, as shown in FIG. 3, is deposited uniformly over the Sn-plated layer, the lacquerability is enhanced, particularly in the case of an Sn-plating followed by the melt treatment. In this regard, when a steel sheet is used for the container for an aqueous solution of organic acid, such as a citric acid, and hence is exposed to a corrosive environment, the corrosive aqueous solution intrudes through the lacquer layer, so that the corrosion of the metallic Sn becomes relatively serious. The Cr layer, which precipitates in the metallic form, advantageously suppresses the corrosive aqueous solution from reaching the metallic Sn surface. Provided that the deposition amount of the chromium bearing layer is within the range as described above, the ratio of metallic chromium layer to the chromium oxide layer is preferably within the range of from 0.2≦chromium oxides/metallic chromium≦3. When the amount of chromium oxides mainly composed of $Cr^{+3}$ is smaller than the amount of metallic Cr, the lacquer adhesion becomes poor since the oxide chromium exhibits a poorer property for a uniform coating than does the metallic chromium. On the other hand, when the amount of chromium oxide is greater than the amount of metallic chromium, the anions and $Cr^{+6}$ ions contained in the oxide chromium increase and are dissolved when exposed, after lacquering, to a high temperature, corrosive atmosphere, thereby making it easy to form minute swellings in the lacquer, i.e., so called blisters. A more preferred ratio of a chromium oxide to metallic chromium is from 0.5 to 2.5.

At the melt treatment, a trace amount of metallic Ni diffuses to the surface of the Sn plated layer and precipitates there. The precipitated Ni advantageously suppresses the undercutting corrosion and greatly improves the lacquer adhesion on the chromate coating. The anions are preferably added to the chromate treating bath in the form of sulfuric acid, chromium sulfate, ammonium fluoride, and sodium fluoride.

The surface treated steel strip according to the present invention as described above can be produced in the various continuous plating lines used at present for the production of tin plates, but these lines must be equipped with the Fe-Ni-P plating apparatus. Accordingly, the production of the surface treated steel strip according to the present invention is efficient.

The Sn-based multilayer coating structure according to the present invention may be present on the steel sheet in any form, such as an entire coating of the steel sheet, which is the most general form, or a partial coating provided by a partial coating process.

The present invention is hereinafter described by way of examples.

The surfaces of the cold-rolled steel strips were cleaned and then subjected to the formation of underlying coating of ternary alloy of Fe-Ni-P. The electroplating conditions for forming the underlying coating of ternary Fe-Ni-P alloy were as given in (A).

Subsequently, a predetermined amount of Sn-coating layer is formed on the underlying coating. Subsequently, rinsing with water or a melt treatment at 260° C. for 5 seconds was carried out, and then the chromate treatment under the conditions (C) was carried out. After an application of oil, various tests were carried out for evaluating the properties of the multilayer coating, as described in Ⓐ - Ⓕ, below.

(A) Treatment for underlying coating of Fe-Ni-P based alloy

| based alloy | | |
|---|---|---|
| Composition of plating bath | $NiSO_4.6H_2O$ | 75 g/l |
| | $NiCl_2.6H_2O$ | 140 g/l |
| | $FeSO_4.7H_2O$ | 64 g/l |
| | $H_3PO_3$ | 44 g/l |
| | $H_3BO_3$ | 45 g/l |
| Bath temperature | 50° C. | |
| Current density | 10 A/dm$^2$ | |

(B) Treatment for Sn plating

| Composition of plating bath | |
|---|---|
| tin sulfate | 20~30 g/l |
| phenol sulfonic acid | 25~35 g/l (65% solution) |
| Bath temperature | 50° C. |
| Current density | 15 A/dm$^2$ |

(C) Chromate treatment (Electric cathodic method)

| | |
|---|---|
| Treatment(a): | Bath composition $Na_2Cr_2O_7$ - 25 g/l<br>Bath temperature 60° C.<br>Current density 5~8 A/dm$^2$<br>Time 2 seconds |
| Treatment(b): | Bath composition 100 g/l $CrO_3$ - 0.6 g/l $SO_4^{-2}$<br>Bath temperature 45° C.<br>Current density 60~80 A/dm$^2$<br>Time 0.1 second |

Ⓐ Uniform coating of plated Sn layer

The plated test pieces 10 mm×10 mm in size were immersed in the test liquid which contained 0.2 mol of sodium carbonate and 0.005 mol of sodium chloride, and the pH of which was adjusted to pH 10 by an addition of sodium hydrogen carbonate. The test pieces were connected as an anode having a constant potential of 1.2 V relative to a standard calomel electrode. The constant anode potential was adjusted by a potentiostat. The test pieces were thus electrolyzed at the potential of 1.2 V. After 3 minutes of electrolysis, the current was measured to evaluate the uniformity of the coating of the plated Sn layer.

Ⓑ Seam Weldability

The cans were welded under the conditions of a lapping amount of 0.5 mm, welding applied force of 45 kg, and a welding speed of 420 cans/minute. During the welding, the welding current was varied to ascertain the minimum welding current for obtaining a satisfactory welding strength, and the range of welding current, in which such welding defects as splashing noticeably occur, as well as the circumstances of the generation of welding defects. The seam weldability was evaluated by considering the above collectively.

Ⓒ UCC Test (Undercut film corrosion test)

An epoxyphenol resin lacquer (phenol enriched lacquer) used for can manufacture was applied on the tested surface of test pieces at a dry weight of 50 mg/dm$^2$ per one side, and was then baked at 205° C. for 10 minutes, and further, at 180° C. for 20 minutes for postbaking. The lacquered surface was scratched with a knife. The test pieces were immersed in the corrosive liquid (1.5% citric acid and 1.5% sodium chloride) and held at 55° C. for 4 days in an open ambient atmosphere. Tapes adhered to the scratched part and flat part were peeled from these parts. The peeling states of the lacquer on the flat and scratched parts as well as the pitting corrosion of the scratched parts were investigated.

Ⓓ Sulfide stain test

The test pieces were lacquered as in C and were subjected to the 1 t bending (bent around 1 mm thick sheet). Water-boiled mackerel available in the market was uniformalized by a mixer. The test pieces were immersed in the uniformalized mackerel and treated in a retort at 115° C. for 90 minutes. After the treatment in the retort, the sulfide staining of the test pieces were evaluated at the bent and flat parts.

Ⓔ Filiform corrosion test

The test pieces were lacquered and scratched as in Ⓒ and then subjected to bulging to 4 mm at the central portion thereof. The samples were then sprayed with 5% NaCl for 3 hours by a sodium chloride-water spraying machine.

The test pieces were rinsed with water and then put in a thermostat testor, in which the constant temperature in terms of a dry bulb temperature was 38° C. and a wet bulb temperature was 35.5° C. and the constant humidity in terms of relative humidity was 85%. The test pieces were allowed to stand in the thermostat testor for 60 days. The scratched parts of the lacquer were observed with the naked eye to detect and evaluate the generation of filiform corrosion.

Ⓕ Evaluation of properties of material to be worked as EOE

An epoxy phenol resin-based lacquer was applied on the samples in an amount of 45 mg/dm$^2$ so as to provide corrosion protection of the inner surface of the samples which were later worked to form EOEs. The occurrence of cracks on the rivetted, and scored (75 μm of the score remaining thickness) parts, as well as the counter sunk parts, was observed.

The test under the same conditions as in Ⓒ-U.C.C. test- was carried out.

The occurrence of corrosion under the lacquer was observed and evaluated.

The sulfide staining was observed and evaluated under the same conditions as in Ⓓ -sulfide stain test-.

The test pieces, which were worked as EOEs, were subjected to a retort treatment while immersed in a 5% NaCl solution at 125° C. for 1 hour. An adhesive tape was attached to and then peeled from the lacquer of test pieces to evaluate the peeling of lacquer.

The results of observation and evaluation as above were collectively evaluated to determine the material properties after the EOE working.

TABLE 1

| Example | (Ni—Fe—P) Alloy plating layer: Plating amount ($mg/m^2$) | Ni wt % | P wt % | Sn Coating amount ($mg/m^2$) | Melting treatment | Electrolytic chromate treatment: Treating method | Amount of metallic chromium ($mg/m^2$) | Amount of total chromium ($mg/m^2$) | Ⓐ Coating uniformity of Sn plated layer | Ⓑ Seam weld-ability | Ⓒ UCC evaluation test: Cross cut parts | Flat parts | Ⓓ Sulfide Stain test: Bending formed parts | Flat parts | Ⓔ Filiform corrosion test | Ⓕ Evaluation test for EOE forming materials |
|---|---|---|---|---|---|---|---|---|---|---|---|---|---|---|---|---|
| Example 1 | 12 | 18 | 1.6 | 620 | yes | (b) | 3 | 7.9 | o | ◎ | ◎ | ◎ | ◎ | ◎ | ◎ | ◎ |
| Example 2 | 110 | 22 | 2.1 | 780 | yes | (a) | 2 | 7.8 | ◎ | ◎ | ◎ | ◎ | ◎ | ◎ | o~◎ | o |
| Example 3 | 290 | 13 | 2.8 | 890 | yes | (b) | 7 | 14.5 | ◎ | ◎ | ◎ | ◎ | ◎ | ◎ | ◎ | ◎ |
| Example 4 | 50 | 5.3 | 1.3 | 750 | yes | (b) | 9 | 12.0 | ◎ | ◎ | ◎ | ◎ | ◎ | ◎ | ◎ | ◎ |
| Example 5 | 150 | 17 | 2.6 | 670 | yes | (b) | 10 | 13.1 | ◎ | ◎ | ◎ | ◎ | ◎ | ◎ | ◎ | ◎ |
| Example 6 | 210 | 28 | 1.9 | 810 | yes | (b) | 4 | 15.0 | ◎ | ◎ | ◎ | ◎ | ◎ | ◎ | ◎ | ◎ |
| Example 7 | 120 | 14 | 0.12 | 820 | yes | (b) | 7 | 12.0 | ◎ | o | ◎ | ◎ | ◎ | ◎ | ◎ | ◎ |
| Example 8 | 180 | 17 | 2.2 | 690 | yes | (b) | 11 | 18.0 | ◎ | ◎ | ◎ | ◎ | ◎ | ◎ | ◎ | ◎ |
| Example 9 | 160 | 16 | 5.0 | 730 | yes | (b) | 12 | 21.0 | ◎ | ◎ | ◎ | ◎ | ◎ | ◎ | o | ◎ |
| Example 10 | 190 | 22 | 9.8 | 750 | yes | (b) | 9 | 34.0 | o | ◎ | o | o | ◎ | ◎ | o | ◎ |
| Example 11 | 200 | 8 | 1.6 | 55 | yes | (b) | 8 | 17.0 | o | o | ◎ | ◎ | ◎ | ◎ | o | ◎ |
| Example 12 | 180 | 11 | 2.2 | 220 | yes | (b) | 7 | 16.0 | o~◎ | o | ◎ | ◎ | ◎ | ◎ | ◎ | ◎ |
| Example 13 | 210 | 13 | 2.4 | 560 | yes | (b) | 9 | 21.0 | ◎ | o~◎ | ◎ | ◎ | ◎ | ◎ | ◎ | ◎ |
| Example 14 | 220 | 9 | 3.6 | 1120 | yes | (a) | 2 | 5.4 | ◎ | ◎ | ◎ | ◎ | o | ◎ | o~◎ | ◎ |
| Example 15 | 170 | 18 | 4.8 | 1780 | yes | (b) | 8 | 18.0 | ◎ | ◎ | ◎ | ◎ | ◎ | ◎ | ◎ | ◎ |
| Example 16 | 180 | 22 | 2.6 | 2480 | yes | (a) | 1 | 6.1 | ◎ | ◎ | o | ◎ | o | ◎ | o~◎ | ◎ |
| Example 17 | 90 | 26 | 1.9 | 60 | no | (a) | 2 | 5.5 | ◎ | o | ◎ | ◎ | o | ◎ | o | ◎ |
| Example 18 | 120 | 14 | 2.7 | 670 | no | (b) | 8 | 14.0 | ◎ | ◎ | ◎ | ◎ | ◎ | ◎ | o | ◎ |
| Example 19 | 150 | 18 | 2.3 | 910 | no | (b) | 9 | 18.0 | ◎ | ◎ | ◎ | ◎ | ◎ | ◎ | o | ◎ |
| Example 20 | 110 | 18 | 1.7 | 1480 | no | (a) | 2.5 | 7.7 | ◎ | ◎ | o | ◎ | o | ◎ | ◎ | o |
| Example 21 | 190 | 21 | 4.8 | 2320 | no | (b) | 7 | 16.0 | o~◎ | ◎ | ◎ | ◎ | ◎ | ◎ | ◎ | ◎ |
| Example 22 | 150 | 22 | 1.9 | 720 | yes | (a) | 1.5 | 6.0 | ◎ | ◎ | o | ◎ | o | ◎ | o~◎ | ◎ |
| Example 23 | 140 | 24 | 2.3 | 740 | yes | (a) | 2 | 7.3 | ◎ | O | ◎ | ◎ | o | ◎ | o~◎ | ◎ |
| Example 24 | 190 | 19 | 1.4 | 820 | yes | (a) | 2 | 12.1 | ◎ | ◎ | ◎ | ◎ | o | ◎ | o~◎ | ◎ |
| Example 25 | 220 | 18 | 2.1 | 820 | yes | (b) | 4 | 5.5 | ◎ | ◎ | ◎ | ◎ | o | ◎ | ◎ | ◎ |
| Example 26 | 160 | 13 | 1.8 | 770 | yes | (b) | 10 | 12.1 | ◎ | ◎ | ◎ | ◎ | ◎ | ◎ | ◎ | ◎ |
| Example 27 | 120 | 12 | 2.3 | 630 | yes | (b) | 19 | 31 | ◎ | o | ◎ | ◎ | ◎ | ◎ | ◎ | ◎ |
| Example 28 | 180 | 11 | 1.3 | 690 | yes | (b) | 30 | 48 | ◎ | Δ~o | ◎ | ◎ | ◎ | ◎ | ◎ | ◎ |
| Example 29 | 40 | 10 | 2.0 | 690 | yes | (b) | 9 | 15.0 | ◎ | ◎ | ◎ | ◎ | ◎ | ◎ | ◎ | ◎ |
| | 160 | 20 | 3.0 | | | | | | | | | | | | | |
| Example 30 | 180 | 15 | 2.4 | 890 | yes | (b) | 11 | 19.0 | ◎ | ◎ | ◎ | ◎ | ◎ | ◎ | ◎ | ◎ |
| | 70 | 10 | 1.8 | | | | | | | | | | | | | |

◎ - extremely good!
o - relatively good!
Δ - relatively poor!
x - extremely poor!

TABLE 2

| | (Ni—Fe—P) Alloy plating layer | | | Sn | | Electrolytic chromate treatment | | |
|---|---|---|---|---|---|---|---|---|
| | (per one surface) Plating amount (mg/m²) | Ni wt % | P wt % | Coating amount (per one surface) (mg/m²) | Melting treatment | Treating method | Amount of metallic chromium (per one surface) (mg/m²) | Amount of total chromium (per one surface) (mg/m²) |
| Comparative 1 | 200 | 16 | 12 | 870 | yes | (a) | 0 | 6.8 |
| Comparative 2 | 180 | 14 | 0.05 | 780 | no | (a) | 0 | 8.8 |
| Comparative 3 | 220 | 3.6 | 3.5 | 770 | no | (b) | 3 | 12.0 |
| Comparative 4 | 240 | 48 | 2.7 | 860 | yes | (b) | 7 | 18.5 |
| Comparative 5 | 800 | 15 | 6.5 | 900 | yes | (b) | 6 | 14.0 |
| Comparative 6 | 18 | 17 | 3.1 | 890 | no | (b) | 4 | 11.0 |
| Comparative 7 | 120 | 14 | 1.5 | 270 | no | (b) | 5 | 12.0 |
| Comparative 8 | 200 | 15 | — | 650 | yes | (b) | 6 | 18.0 |
| Comparative 9 | 100 | — | 2.0 | 680 | no | (b) | 5 | 14.0 |
| Comparative 10 | — | — | — | 770 | no | (a) | 0 | 7.4 |

| | Ⓐ Coating uniformity of Sn plated layer | Ⓑ Seam weldability | Ⓒ UCC evaluation test: Cross cut parts | Ⓒ UCC evaluation test: Flat parts | Ⓓ Sulfide stain test: Flat parts | Ⓓ Sulfide stain test: Bending formed parts | Ⓔ Filiform corrosion test | Ⓕ Evaluation test for EOE forming materials |
|---|---|---|---|---|---|---|---|---|
| Comparative 1 | x | ◎ | x | x | o | Δ | x | x |
| Comparative 2 | ◎ | Δ | Δ | Δ | o | Δ | Δ | ∂ |
| Comparative 3 | x | o | Δ | Δ | o | Δ | Δ | x |
| Comparative 4 | ◎ | x | Δ | Δ | ◎ | o | o | x |
| Comparative 5 | x | ◎ | Δ | Δ | o | o | Δ | x |
| Comparative 6 | Δ | Δ | Δ | Δ | ◎ | o | Δ | x |
| Comparative 7 | x | x | x | x | o | Δ | x | x |
| Comparative 8 | ◎ | Δ | ◎ | ◎ | ◎ | o | o | x |
| Comparative 9 | x | ◎ | Δ | Δ | o | o | Δ | x |
| Comparative 10 | x | x | x | x | x | x | x | x |

We claim:

1. A method for producing a surface-treated steel strip for use as a container, having improved properties, characterized by, electroplating on the steel strip a Fe-Ni-P based underlying coating layer having a weight of from 10 to 300 mg/m² and containing from 5% to 30% Ni and from 0.1% to 10% P, and then electroplating a Sn layer, heating and melting the Sn plated layer to form a Fe-Ni-Sn-P based alloy, while leaving metallic Sn on the layer of the Fe-Ni-Sn-P based alloy, and subsequently forming a chromate coating layer.

2. A method according to claim 1, wherein the Sn plated layer has a weight of from 50 to 2500 mg/m².

3. A method according to claim 1 or 2, wherein said heating is carried out at a temperature of from 240° to 350° C.

4. A method according to claim 1 or 2, wherein the chromate coating layer has a weight of from 5 to 50 mg/m² of a surface of the steel strip.

5. A method according to claim 1 or 2, wherein said chromate coating layer comprises chromium oxide and metallic chromium in a weight ratio of the chromium oxide/metallic chromium of from 0.2 to 3.0.

6. A method according to claim 1 wherein the Fe-Ni-P based layer is only partially converted to the Fe-Ni-Sn-P based layer.

7. A method according to claim 1 wherein the Fe-Ni-P based layer is fully converted to the Fe-Ni-Sn-P based layer.

8. A method for producing a surface-treated steel strip for use as a container, having improved properties, characterized by, electroplating on the steel strip a Fe-Ni-Sn-P based coating layer having a weight of from 50 to 1500 mg/m² and containing from 2% to 20% Ni, from 0.05% to 5% P, from 20% to 50% Fe, the balance being Sn, electroplating a Sn layer on the Fe-Ni-Sn-P layer, and subsequently forming a chromate coating layer.

9. A method according to claim 8 wherein the Sn plated layer has a weight of not less than 30 mg/m².

10. A method according to claim 8 or 9 wherein the chromate coating layer has a weight of from 5 to 50 mg/m².

11. A method according to claim 8 or 9 wherein the chromate coating layer comprises chromium oxide and metallic chromium in a weight ratio of the chromium oxide/metallic chromium of from 0.2 to 3.0.

12. A method according to claim 10 wherein the chromate coating layer comprises chromium oxide and metallic chromium in a weight ratio of the chromium oxide/metallic chromium of from 0.2 to 3.0.

* * * * *

UNITED STATES PATENT AND TRADEMARK OFFICE

CERTIFICATE OF CORRECTION

PATENT NO. : 4,790,913
DATED : December 13, 1988
INVENTOR(S) : Higuchi, et al.

It is certified that error appears in the above-identified patent and that said Letters Patent is hereby corrected as shown below:

Column 1, line 41, change "cause" to --causes--.

Column 2, lines 14 and 15, change "...Undercoating: (Fe-20% Ni) alloy plating (200 O mg/$m^2$)" to --O...Undercoating (Fe-20% Ni) alloy plating (200 mg/$m^2$)--.

Column 2, line 51, change "recent" to --recently--.

Column 3, line 47, change "coulubm" to --coulomb--.

Column 4, line 37, change "contents ensure" to --contents, ensures--.

Column 5, line 58, between "layer" and "practically" insert --is--.

Column 8, line 48, omit "of" between "time" and "in".

Column 9, line 65, change "$H_3BO_3$" to --$H_3PO_3$--.

UNITED STATES PATENT AND TRADEMARK OFFICE

CERTIFICATE OF CORRECTION

PATENT NO. : 4,790,913

DATED : December 13, 1988

INVENTOR(S) : Higuchi, et al.

It is certified that error appears in the above-identified patent and that said Letters Patent is hereby corrected as shown below:

Column 11, line 4, change "were" to --was--.

Column 16, line 24, change "∋" to --x--.

Signed and Sealed this

First Day of August, 1989

*Attest:*

*Attesting Officer*

DONALD J. QUIGG

*Commissioner of Patents and Trademarks*